US012492847B2

(12) United States Patent
Gotanda et al.

(10) Patent No.: US 12,492,847 B2
(45) Date of Patent: Dec. 9, 2025

(54) CRYOPUMP

(71) Applicant: SUMITOMO HEAVY INDUSTRIES, LTD., Tokyo (JP)

(72) Inventors: Shuhei Gotanda, Tokyo (JP); Takahiro Nakanishi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 242 days.

(21) Appl. No.: 18/235,239

(22) Filed: Aug. 17, 2023

(65) Prior Publication Data

US 2023/0392831 A1 Dec. 7, 2023

Related U.S. Application Data

(63) Continuation of application No. PCT/JP2022/005295, filed on Feb. 10, 2022.

(30) Foreign Application Priority Data

Mar. 11, 2021 (JP) ..... 2021-039148

(51) Int. Cl.
*F04B 37/00* (2006.01)
*F04B 37/08* (2006.01)
*F25B 9/14* (2006.01)

(52) U.S. Cl.
CPC ..... *F25B 9/145* (2013.01); *F04B 37/08* (2013.01)

(58) Field of Classification Search
CPC ..... F04B 37/08; F04B 37/085; F25B 9/14
See application file for complete search history.

(56) References Cited

U.S. PATENT DOCUMENTS 5,333,466 A * 8/1994 Harrington ..... F04B 37/08 62/55.5
8,800,304 B2 8/2014 Koyama
2005/0034465 A1 2/2005 Borchers et al.
2009/0038319 A1 2/2009 Tsuyuki
2009/0165470 A1* 7/2009 Aoki ..... F04B 37/085 165/95

(Continued)

FOREIGN PATENT DOCUMENTS

JP S61-294176 A 12/1986
JP S63-285278 A 11/1988

(Continued)

*Primary Examiner* — Brian M King
(74) *Attorney, Agent, or Firm* — Michael Best & Friedrich LLP

(57) ABSTRACT

A cryopump includes: a cryopump container including a container body defining a cryopump intake port and extending axially and tubularly from the cryopump intake port, and a cryocooler accommodation cylinder connected to a side portion of the container body and extending transversely; a cryocooler fixed to the cryocooler accommodation cylinder and extending transversely within the cryopump container; a plurality of cryopanels thermally coupled to the second cooling stage of the cryocooler, capable of adsorbing a non-condensable gas, and axially arranged between the cryopump intake port and a bottom portion of the container body; and a purge gas inlet installed in the container body below the cryocooler accommodation cylinder to blow a purge gas to a distal portion of at least one of the cryopanels.

12 Claims, 5 Drawing Sheets

(56) References Cited

U.S. PATENT DOCUMENTS

| | | | | |
|---|---|---|---|---|
| 2013/0192276 | A1* | 8/2013 | Tanaka | B23P 15/26<br>29/888.021 |
| 2016/0258429 | A1* | 9/2016 | Oikawa | F04B 37/08 |

FOREIGN PATENT DOCUMENTS

| | | | |
|---|---|---|---|
| JP | H08-061232 | A | 3/1996 |
| JP | H09-014133 | A | 1/1997 |
| JP | H09-126125 | A | 5/1997 |
| JP | H10-089247 | A | 4/1998 |
| JP | 2000-161214 | A | 6/2000 |
| JP | 2005-048764 | A | 2/2005 |
| JP | 2009-057957 | A | 3/2009 |
| JP | 2011-137423 | A | 7/2011 |
| JP | 2012-047120 | A | 3/2012 |
| JP | 2013-002328 | A | 1/2013 |
| JP | 2017-044107 | A | 3/2017 |

* cited by examiner

CRYOPUMP

CROSS-REFERENCE TO RELATED APPLICATIONS

This is a bypass continuation of International PCT Application No. PCT/JP2022/005295, filed on Feb. 10, 2022, which claims priority to Japanese Patent Application No. 2021-039148, filed on Mar. 11, 2021, which are incorporated by reference herein in their entirety.

BACKGROUND

Technical Field

Certain embodiments of the present invention relate to a cryopump.

Description of Related Art

A cryopump is a vacuum pump that captures gas molecules on a cryopanel cooled to a cryogenic temperature by condensation or adsorption and exhausts the gas molecules. The cryopump is generally used to realize a clean vacuum environment which is required for a semiconductor circuit manufacturing process or the like. Since the cryopump is a so-called gas accumulation type vacuum pump, regeneration to periodically discharge the captured gas to the outside is required.

SUMMARY

According to an embodiment of the present invention, there is provided a cryopump including: a cryopump container that includes a container body and a cryocooler accommodation cylinder, the container body defining a cryopump intake port and extending tubularly from the cryopump intake port in an axial direction of the container body, the cryocooler accommodation cylinder connected to a side portion of the container body and extending in a transverse direction perpendicular to the axial direction of the container body; a cryocooler fixed to the cryocooler accommodation cylinder and extending in the transverse direction within the cryopump container, the cryocooler including a first cooling stage and a second cooling stage that is cooled to a lower temperature than the first cooling stage; a plurality of cryopanels thermally coupled to the second cooling stage, each configured to adsorb a non-condensable gas and including a distal portion away from the second cooling stage, wherein the plurality of cryopanels are axially arranged between the cryopump intake port and a bottom portion of the container body, or wherein the plurality of cryopanels are radially arranged when viewed from the cryopump intake port; and a purge gas inlet installed in the container body at a position below the cryocooler accommodation cylinder so as to blow a purge gas from the purge gas inlet to the distal portion of at least one of the cryopanels.

DETAILED DESCRIPTION

Figure 1:
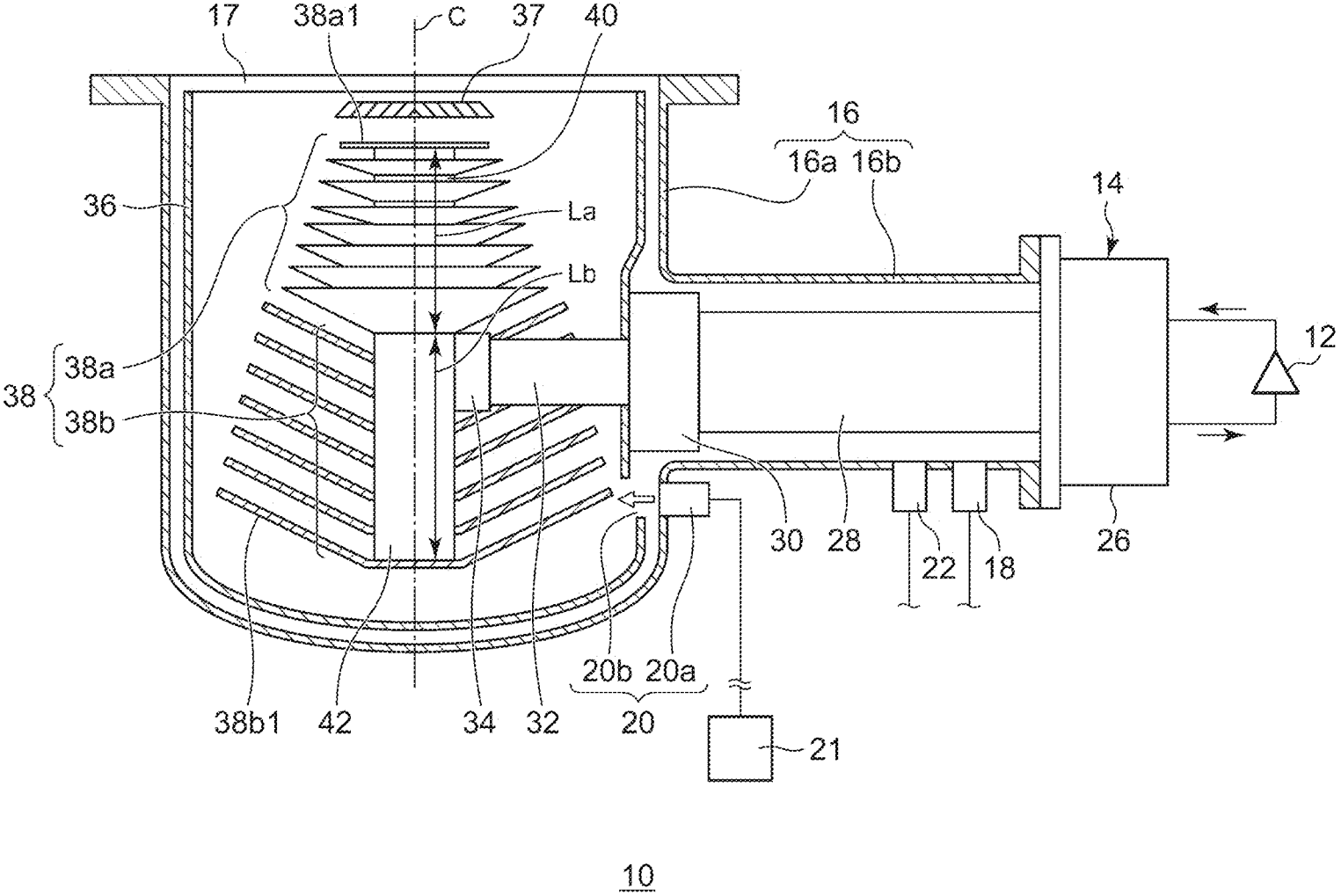
FIG. 1 is a diagram schematically showing a cryopump according to an embodiment.

It is desirable to reduce a regeneration time of a cryopump.

Any combinations of the components described above or mutual replacement of the components or expressions of the present invention in methods, devices, systems, or the like are also effective as aspects of the present invention.

According to the present invention, it is possible to reduce a regeneration time of the cryopump.

Hereinafter, an embodiment for carrying out the present invention will be described in detail with reference to the drawings. In the description and drawings, identical or equivalent components, members, and processing are denoted by the same reference numerals, and overlapping description is omitted as appropriate. The scale or shape of each part that is shown in the drawings is conveniently set for ease of description and is not limitedly interpreted unless otherwise specified. The embodiments are exemplary and do not limit the scope of the present invention in any way. All features or combinations thereof described in the embodiments are not essential to the invention.

FIG. 1 is a diagram schematically showing a cryopump 10 according to an embodiment. The cryopump 10 is mounted on, for example, a vacuum chamber of an ion implanter, a sputtering apparatus, a vapor deposition apparatus, or other vacuum process apparatus and used to increase the degree of vacuum inside the vacuum chamber to a level that is required for a desired vacuum process. For example, the high degree of vacuum in a range of about $10^{-5}$ Pa to $10^{-8}$ Pa is realized in the vacuum chamber.

The cryopump 10 includes a compressor 12, a cryocooler 14, and a cryopump container 16 that includes a cryopump intake port 17. Further, the cryopump 10 includes a rough valve 18, a purge valve 20*a*, and a vent valve 22, which are installed in the cryopump container 16. The cryopump 10 includes a radiation shield 36 and a plurality of cryopanels 38 accommodated in the cryopump container 16. The purge valve 20*a* configures a purge gas inlet 20 together with an opening portion 20*b* provided in the radiation shield 36.

The compressor 12 is configured to recover a refrigerant gas from the cryocooler 14, pressurize the recovered refrigerant gas, and supply the refrigerant gas to the cryocooler 14 again. The cryocooler 14 is also referred to as an expander or a cold head and configures a cryogenic refrigerator together with the compressor 12. The circulation of the refrigerant gas between the compressor 12 and the cryocooler 14 is performed with an appropriate combination of the pressure fluctuation and volume fluctuation of the refrigerant gas in the cryocooler 14, so that a thermodynamic cycle that generates cold is configured, and the cryocooler 14 can provide cryogenic cooling. Although the refrigerant gas is typically a helium gas, any other appropriate gas may be used. In order to facilitate understanding, a direction in which the refrigerant gas flows is indicated with an arrow in FIG. 1. The cryogenic refrigerator is a two-stage Gifford-McMahon (GM) cryocooler as an example. However, it may also be a pulse tube cryocooler, a Stirling cryocooler, or other types of cryogenic refrigerators.

The cryocooler 14 includes a room temperature part 26, a first cylinder 28, a first cooling stage 30, a second cylinder 32, and a second cooling stage 34. The cryocooler 14 is configured to cool the first cooling stage 30 to a first cooling temperature and the second cooling stage 34 to a second cooling temperature. The second cooling temperature is lower than the first cooling temperature. For example, the first cooling stage 30 is cooled to a temperature in a range of about 65 K to 120 K, preferably in a range of 80 K to 100 K, and the second cooling stage 34 is cooled to a temperature in a range of about 10 K to 20 K. The first cooling stage 30 and the second cooling stage 34 may also be referred to as a high-temperature cooling stage and a low-temperature cooling stage, respectively.

The first cylinder 28 connects the first cooling stage 30 to the room temperature part 26, so that the first cooling stage 30 is structurally supported on the room temperature part 26. The second cylinder 32 connects the second cooling stage 34 to the first cooling stage 30, so that the second cooling stage 34 is structurally supported on the first cooling stage 30. The first cylinder 28 and the second cylinder 32 extend coaxially, and the room temperature part 26, the first cylinder 28, the first cooling stage 30, the second cylinder 32, and the second cooling stage 34 are linearly arranged in a line in this order.

In a case where the cryocooler 14 is a two-stage GM cryocooler, a first displacer and a second displacer (not shown) are disposed to be able to reciprocate inside the first cylinder 28 and the second cylinder 32, respectively. A first regenerator and a second regenerator (not shown) are respectively incorporated into the first displacer and the second displacer. Further, the room temperature part 26 has a drive mechanism (not shown) such as a motor for reciprocating the first displacer and the second displacer. The drive mechanism includes a flow path switching mechanism that switches a flow path for a working gas (for example, helium) so as to periodically repeat the supply and discharge of the working gas to the interior of the cryocooler 14.

The cryopump container 16 includes a container body 16*a* and a cryocooler accommodation cylinder 16*b*. The cryopump container 16 is a vacuum vessel designed to hold vacuum during a vacuum exhaust operation of the cryopump 10 and to withstand the pressure of ambient environment (for example, atmospheric pressure). The container body 16*a* defines the cryopump intake port 17 and extends in a tubular shape in an axial direction (a direction along a cryopump center axis C shown in FIG. 1) from the cryopump intake port 17. The container body 16*a* has a tubular shape with the cryopump intake port 17 at one end in the axial direction and a closed other end in the axial direction. The radiation shield 36 is accommodated in the container body 16*a*, and the cryopanels 38 are accommodated in the radiation shield 36 together with the second cooling stage 34. One end of the cryocooler accommodation cylinder 16*b* is coupled to the container body 16*a*, and the other end is fixed to the room temperature part 26 of the cryocooler 14. The cryocooler 14 is inserted into the cryocooler accommodation cylinder 16*b*, and the first cylinder 28 is accommodated in the cryocooler accommodation cylinder 16*b*.

In this embodiment, the cryopump 10 is a so-called horizontal cryopump in which the cryocooler 14 is provided at a side portion of the container body 16*a*. The cryocooler 14 is fixed to the cryocooler accommodation cylinder 16*b* and extends in the direction perpendicular to the axial direction in the cryopump container 16. A cryocooler insertion opening is provided in the side portion of the container body 16*a*, and the cryocooler accommodation cylinder 16*b* is coupled to the side portion of the container body 16*a* at the cryocooler insertion opening. Similarly, a hole through which the cryocooler 14 passes is also provided in a side portion of the radiation shield 36 adjacent to the cryocooler insertion opening of the container body 16*a*. The second cylinder 32 and the second cooling stage 34 of the cryocooler 14 are inserted into the radiation shield 36 through the hole, and the radiation shield 36 is thermally coupled to the first cooling stage 30 around the hole of the side portion.

The cryopump can be installed in various postures at the site of use. As an example, the cryopump 10 can be installed in the illustrated sideways posture, that is, in a posture with the cryopump intake port 17 facing upward. At this time, the bottom portion of the container body 16*a* is located at a position lower than the cryopump intake port 17, and the cryocooler 14 extends in the horizontal direction.

The rough valve 18 is installed in the cryopump container 16, for example, the cryocooler accommodation cylinder 16*b*. The rough valve 18 is connected to a rough pump (not shown) installed outside the cryopump 10. The rough pump is a vacuum pump for evacuating the cryopump 10 to the operation start pressure of the cryopump 10. When the rough valve 18 is opened, the cryopump container 16 communicates with the rough pump, and when the rough valve 18 is closed, the cryopump container 16 is cut off from the rough pump. The cryopump 10 can be depressurized by opening the rough valve 18 and operating the rough pump.

The purge valve 20*a* is installed in the cryopump container 16, and in this embodiment, the purge valve 20*a* is installed in the container body 16*a* below the cryocooler accommodation cylinder 16*b*. The purge valve 20*a* is connected to a purge gas source 21 installed outside the cryopump 10. The radiation shield 36 is provided with the opening portion 20*b* through which a purge gas that is ejected into the cryopump container 16 from the purge valve 20*a* passes into the radiation shield 36. The opening portion 20*b* is provided in front of the purge valve 20*a*. When the purge valve 20*a* is opened, the purge gas is supplied from the purge valve 20*a* into the radiation shield 36 through the opening portion 20*b*, and when the purge valve 20*a* is closed, the purge gas supply to the cryopump container 16 is cut off.

The purge gas may be, for example, a nitrogen gas, or other dry gas, and the temperature of the purge gas may be adjusted to, for example, room temperature or heated to a temperature higher than room temperature. The pressure inside the cryopump 10 can be increased from vacuum to atmospheric pressure or pressure higher than atmospheric pressure by opening the purge valve 20*a* and introducing the purge gas into the cryopump container 16. Further, the temperature of the cryopump 10 can be increased from a cryogenic temperature to room temperature or a temperature higher than room temperature.

In this embodiment, the purge gas inlet 20 is provided in the side portion of the container body 16*a* on the same side as the cryocooler accommodation cylinder 16*b* when viewed from the cryopump intake port 17. The purge gas inlet 20 is provided on the same side as the cryocooler accommodation cylinder 16*b* like other valves such as the rough valve 18, so that the associated pipes or electrical wires can be collectively disposed, and handling of these pipes and wires becomes easy.

The vent valve 22 is installed in the cryopump container 16, for example, the cryocooler accommodation cylinder 16*b*. The vent valve 22 is provided to discharge a fluid from the interior of the cryopump 10 to the outside. The vent valve 22 may be connected to a storage tank (not shown), which receives the fluid to be discharged, outside the cryopump 10. Alternatively, in a case where the discharged fluid is non-hazardous, the vent valve 22 may be configured to release the discharged fluid to ambient environment. The fluid that is discharged from the vent valve 22 is basically a gas. However, it may be a liquid or a gas-liquid mixture.

The vent valve 22 may be, for example, a normally closed control valve, and the vent valve 22 may be opened when a fluid is to be released from cryopump container 16, such as during regeneration, for example, and closed when a fluid is not to be released. The vent valve 22 may be configured to function also as a so-called safety valve that is mechanically opened when a predetermined differential pressure acts. When the interior of the cryopump reaches high pressure for some reason, the vent valve 22 is mechanically opened, so that the high pressure of the interior can be released.

The radiation shield 36 is thermally coupled to the first cooling stage 30 and cooled to the first cooling temperature in order to provide a cryogenic surface for protecting the cryopanel 38 from the radiant heat from the outside of the cryopump 10 or the cryopump container 16. The radiation shield 36 is disposed around the plurality of cryopanels 38 within the container body 16*a*. The radiation shield 36 has, for example, a tubular shape surrounding the cryopanels 38 and the second cooling stage 34. The end portion of the radiation shield 36 on the cryopump intake port 17 side is open, so that the radiation shield 36 can receive a gas entering into through the cryopump intake port 17 from outside the cryopump 10. The end portion of the radiation shield 36 on the side opposite to the cryopump intake port 17 is closed. Alternatively, the end portion of the radiation shield 36 on the side opposite to the cryopump intake port 17 may have an opening or be open. The radiation shield 36 has a gap between itself and the cryopanel 38, and the radiation shield 36 is not in contact with the cryopanel 38. The radiation shield 36 is also not in contact with the cryopump container 16.

The cryopump intake port 17 may be provided with an inlet cryopanel 37 fixed to the open end of the radiation shield 36. The inlet cryopanel 37 is cooled to the same temperature as the radiation shield 36 and condenses a so-called type 1 gas (a gas that condenses at a relatively high temperatures, such as water vapor) on the surface thereof. The inlet cryopanel 37 is, for example, a louver or a baffle. However, it may be, for example, a circular or other shaped plate or member disposed to occupy a portion of the cryopump intake port 17.

The cryopanel 38 is thermally coupled to the second cooling stage 34 and cooled to the second cooling temperature in order to provide a cryogenic surface for condensing a type 2 gas (for example, a gas that condenses at a relatively low temperatures, such as argon, nitrogen, or the like). Further, for example, activated carbon or other adsorbing material is disposed on at least a portion of the surface of the cryopanel 38 in order to adsorb a type 3 gas (for example, a non-condensable gas such as hydrogen). Such an adsorption region may be formed at a place that is not visible from the cryopump intake port 17 (for example, the surface of the cryopanel 38 on the side opposite to the cryopump intake port 17 or a place shaded by the adjacent cryopanel 38 above). The adsorption region of each of the cryopanels 38 may be formed on the entire surface or most of the surface of the cryopanel 38 that is not visible from the cryopump intake port 17. The plurality of cryopanels 38 can also be referred to as adsorption cryopanels because each cryopanel can adsorb a non-condensable gas. A gas that enters the radiation shield 36 from outside the cryopump 10 through the cryopump intake port 17 is captured in the cryopanels 38 by condensation or adsorption.

The radiation shield 36 and the inlet cryopanel 37 that are cooled to the first cooling temperature may be collectively referred to as a high-temperature cryopanel. Since the cryopanel 38 is cooled to the second cooling temperature lower than the first cooling temperature, it can also be referred to as a low-temperature cryopanel.

Each member that is cooled to a cryogenic temperature, such as the radiation shield 36, the inlet cryopanel 37, and the cryopanel 38, is made of, for example, a metal material such as copper or aluminum, or other material with high thermal conductivity. Each member may include a main body made of such a high thermal conductivity material and a coating layer (for example, a nickel layer) covering the main body.

The plurality of cryopanels 38 are arranged in the axial direction between the cryopump intake port 17 and the bottom portion of the container body 16*a*. Hereinafter, for convenience of description, the cryopanels 38 that are disposed above the second cooling stage 34 will be referred to as upper cryopanels 38*a*, and the cryopanels 38 that are disposed below the upper cryopanel 38*a* will be referred to as lower cryopanels 38*b*.

The upper cryopanel 38*a* has an inverted truncated cone shape, and the center of each upper cryopanel 38*a* is located on the cryopump center axis C. The circular central portion of the upper cryopanel 38*a* is disposed perpendicular to the axial direction, and the outer peripheral portion of the upper cryopanel 38*a* is inclined with respect to a plane perpendicular to the axial direction. The outer peripheral portion of the upper cryopanel 38*a* extends obliquely upward radially outward from the central portion. The two upper cryopanels 38*a* adjacent to each other in the axial direction have a gap between their outer peripheral portions, and the gas entering into from the cryopump intake port 17 can be received in the gap. As shown in FIG. 1, some of the upper cryopanels 38*a*, for example, at least one upper cryopanel 38*a* adjacent to the cryopump intake port 17, may be a flat plate (being, for example, circular) instead of an inverted truncated cone shape.

The diameters of the plurality of upper cryopanels 38*a* increase with increasing distance from the cryopump intake port 17. The upper cryopanel 38*a* closest to the cryopump intake port 17 (hereinafter also referred to as a top cryopanel 38*a*1 for convenience) has the smallest diameter. The top cryopanel 38*a*1 is the upper cryopanel 38*a* that is located immediately below the inlet cryopanel 37 and axially farthest from the second cooling stage 34. The upper cryopanels 38*a* increase in diameter as it approaches the second cooling stage 34 from the top cryopanel 38*a*1.

Further, the plurality of upper cryopanels 38*a* may increase in depth (axial distance from the central portion to the outer peripheral portion) with increasing distance from the cryopump intake port 17. The upper cryopanels 38*a* may be nested like some upper cryopanels 38*a* closer to the second cooling stage 34. That is, the lower portion of the upper cryopanel 38*a* located above may enter into the upper cryopanel 38*a* adjacent thereto below. The inclination angle of the outer peripheral portion of the upper cryopanel 38*a* may be as large as that of the upper cryopanel 38*a* located below, as shown in the drawing. The inclination angle may be the same in some (or all) upper cryopanels 38*a* adjacent to each other.

A plurality of heat transfer bodies 40 are provided to mount the plurality of upper cryopanels 38*a* on the second cooling stage 34. The heat transfer body 40 has a short columnar or disk-like shape, and the diameter thereof is equal to the diameter of the central portion of the upper cryopanel 38*a*. The upper cryopanel 38*a* and the heat transfer body 40 are alternately disposed on the cryopump center axis C, so that a columnar portion extending along the cryopump center axis C is formed by the central portions of the upper cryopanels 38*a* and the heat transfer bodies 40. A bolt hole in the axial direction is provided to penetrate the columnar portion to the second cooling stage 34, and a long bolt is inserted into the bolt hole and fastened to the second cooling stage 34. In this way, the upper cryopanels 38*a* and the heat transfer bodies 40 are fixed to the second cooling stage 34 and thermally coupled to the second cooling stage 34. The upper cryopanel 38*a* and the heat transfer body 40 may be joined together by other methods such as bonding or welding.

The plurality of lower cryopanels 38*b* are arranged in the axial direction between the second cooling stage 34 and the bottom portion of the container body 16*a*. Similar to the upper cryopanel 38*a*, the lower cryopanel 38*b* has an inverted truncated cone shape, and the center of each lower cryopanel 38*b* is located on the cryopump center axis C. The lower cryopanel 38*b* has an outer peripheral portion inclined with respect to a plane perpendicular to the axial direction. The outer peripheral portion of the lower cryopanel 38*b* extends obliquely upward radially outward from the central portion. The two lower cryopanels 38*b* adjacent to each other in the axial direction have a gap between their outer peripheral portions, and a gas entering into from the cryopump intake port 17 can be received in the gap.

The lower cryopanel 38*b* has a larger diameter and depth than the upper cryopanel 38*a*, and the diameters and depths of the lower cryopanels 38*b* increase with increasing distance from the cryopump intake port 17. Therefore, the lower cryopanel 38*b* farthest from the second cooling stage 34 (hereinafter also referred to as a bottom cryopanel 38*b*1 for convenience) among the cryopanels 38 has the largest diameter and depth. The lower cryopanels 38*b* may be disposed in a nested manner in the same manner as the upper cryopanels 38*a*. The inclination angle of the outer peripheral portion of the lower cryopanel 38*b* may be as large as the lower cryopanel 38*b* located below, as shown in the drawing. The inclination angle may be the same in some (or all) lower cryopanels 38*b* adjacent to each other.

A cryopanel mounting member 42 is provided in order to mount the lower cryopanel 38*b* on the second cooling stage 34. The cryopanel mounting member 42 is fixed to the second cooling stage 34 and extends axially downward from the second cooling stage 34. The plurality of lower cryopanels 38*b* are axially spaced apart from each other and mounted on the cryopanel mounting members 42 at their central portions. In each lower cryopanel 38*b*, a cutout is formed from the outer peripheral portion to the central portion to receive the second cooling stage 34 and the cryopanel mounting member 42 at the central portion. In this way, the lower cryopanel 38*b* is thermally coupled to the second cooling stage 34 via the cryopanel mounting member 42.

The cryopanels 38 are disposed relatively densely to increase the exhaust speed and storage capacity for a gas (for example, a non-condensable gas). At least three, or at least four, or at least five upper cryopanels 38*a* may be arranged in the axial direction between the inlet cryopanel 37 and the upper surface of the second cooling stage 34. The top cryopanel 38*a*1 may be disposed in proximity to the inlet cryopanel 37, the axial distance from the top cryopanel 38*a*1 to the inlet cryopanel 37 may be smaller than the axial distance from the top cryopanel 38*a*1 to the upper surface of the second cooling stage 34 or may be smaller than half of the axial distance. Alternatively, the axial distance from the top cryopanel 38*a*1 to the inlet cryopanel 37 may be smaller than the axial distance from the top cryopanel 38*a*1 to the upper cryopanel 38*a* adjacent thereto immediately below.

Further, at least three, or at least five, or at least ten lower cryopanels 38*b* may be arranged in the axial direction between the bottom portion of the radiation shield 36 and the upper surface of the second cooling stage 34. The bottom cryopanel 38*b*1 may be disposed in proximity to the bottom portion of the radiation shield 36, and the axial distance from the bottom cryopanel 38*b*1 to the bottom portion of the radiation shield 36 may be smaller than the axial distance from the bottom cryopanel 38*b*1 to the upper surface of the second cooling stage 34, may be smaller than half of the axial distance, or may be smaller than ⅓ of the axial distance. Alternatively, the axial distance from the bottom cryopanel 38*b*1 to the bottom portion of the radiation shield 36 may be smaller than the axial distance from the bottom cryopanel 38*b*1 to the lower cryopanel 38*b* adjacent thereto immediately above.

The bottom cryopanel 38*b*1 is relatively large among the cryopanels 38, and may be the largest. The bottom cryopanel 38*b*1 may be larger than the top cryopanel 38*a*1, and the area of the bottom cryopanel 38*b*1 may be in a range of about 1.5 times to about 5 times the area of the top cryopanel 38*a*1. The diameter of the bottom cryopanel 38*b*1 may be at least 70%, or at least 80%, or at least 90% of the diameter of the cryopump intake port 17.

More space is allocated to the lower cryopanels 38*b* than to the upper cryopanels 38*a*. When an axial distance La from the top cryopanel 38*a*1 to the upper surface of the second cooling stage 34 is 1, an axial distance Lb from the bottom cryopanel 38*b*1 to the upper surface of the second cooling stage 34 may be in a range of 1 to 3, or in a range of 1 to 2. That is, $La \leq Lb \leq 3La$ (or 2La) may be satisfied. In the cryopump 10, a larger number of lower cryopanels 38*b* than the upper cryopanels 38*a* can be disposed.

The plurality of cryopanels 38 are not limited to the specific disposition and shape described above with reference to FIG. 1, and may take various forms. For example, the shape of the cryopanel 38 is not limited to the inverted truncated cone shape, and may be another shape that is convex downward, or another shape such as a flat plate shape. Other exemplary forms of the cryopanel 38 will be described later with reference to FIGS. 3, 4A, and 4B.

Figure 3:
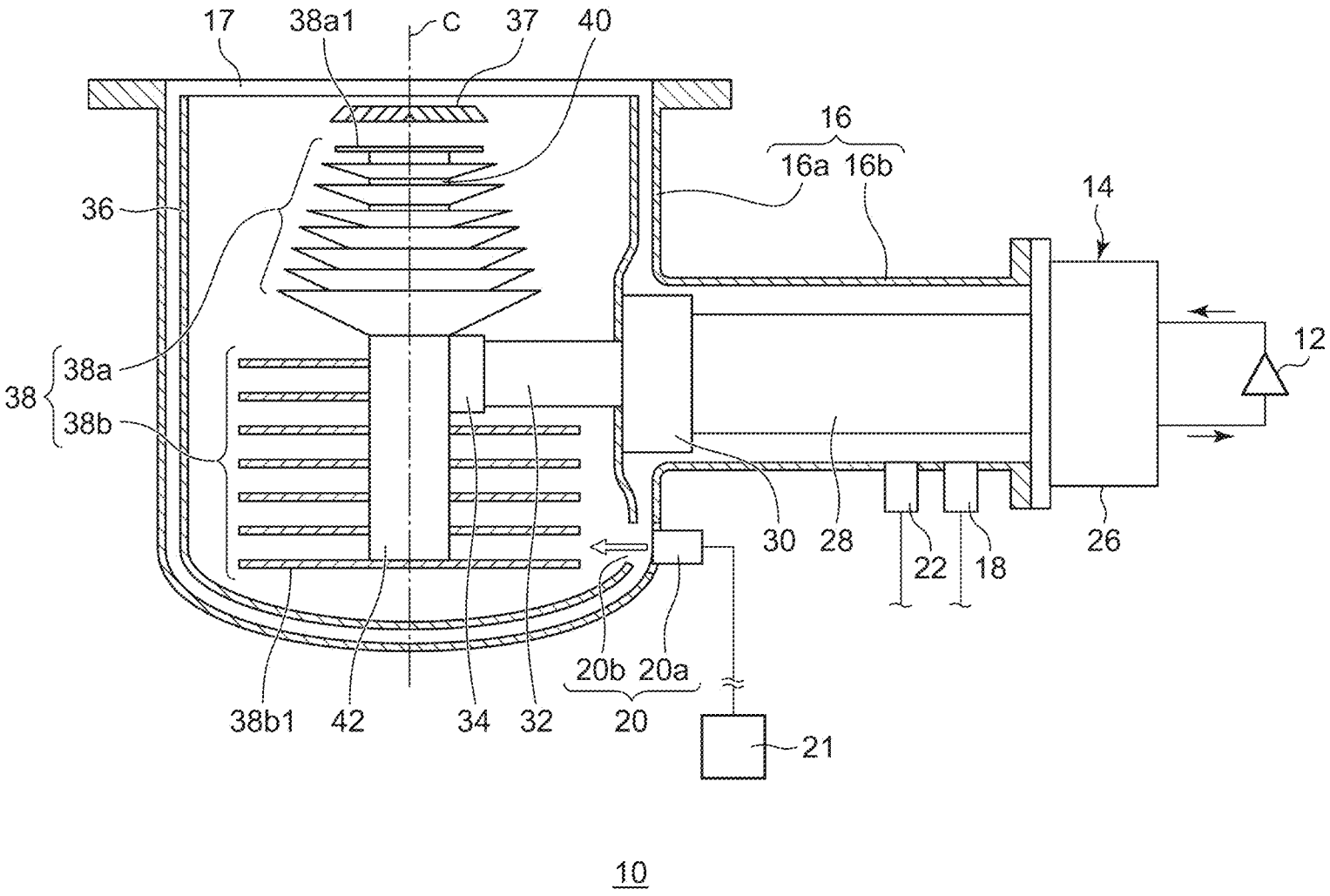
FIG. 3 is a diagram schematically showing a cryopump according to Modification Example 1.
Figure 4A:
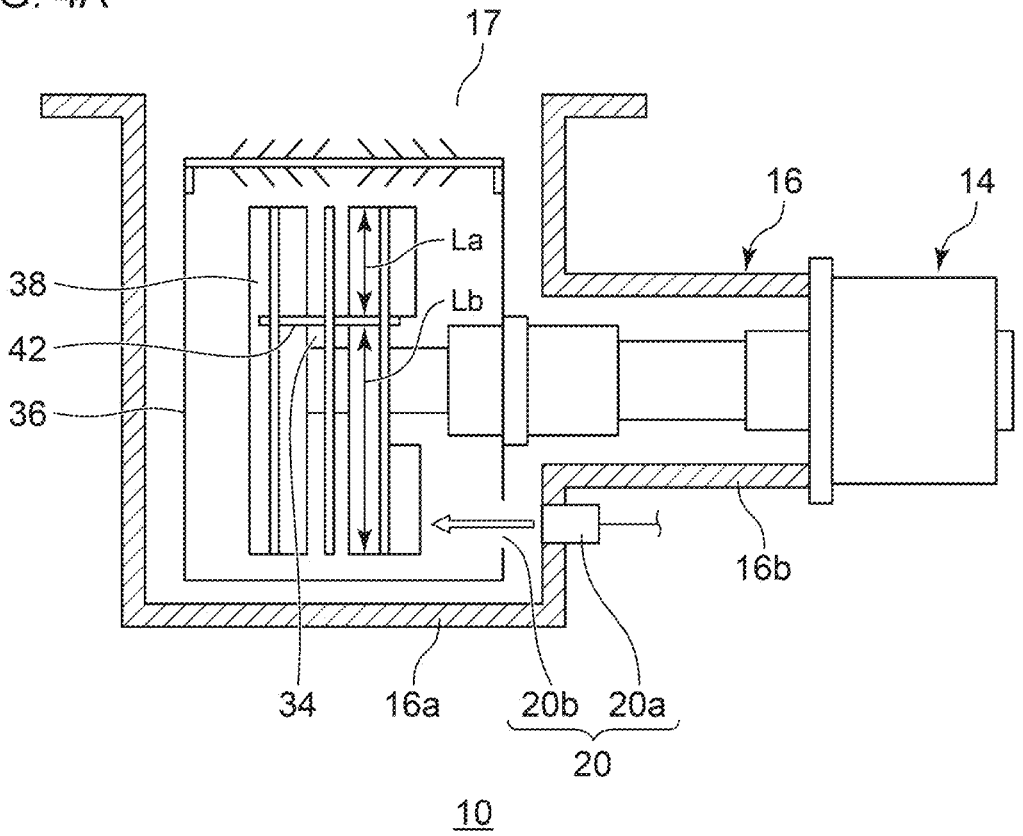
FIGS. 4A and 4B are diagrams schematically showing a cryopump according to Modification Example 2.
Figure 4B:
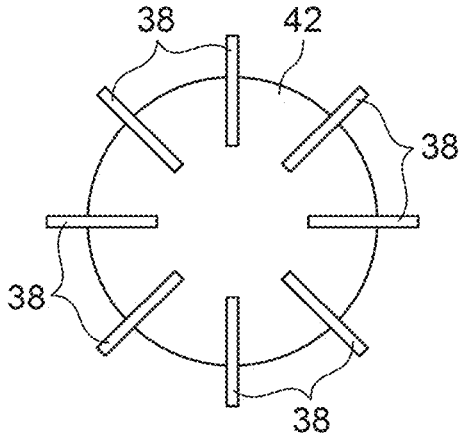

The cryopump 10 is suitable for applications (for example, ion implanters) that exhaust a non-condensable gas such as a hydrogen gas at high speed. The cryopump 10 shown in FIG. 1 is designed to have a hydrogen capture probability of at least 20%, at least 25%, or at least 30%. Further, the cryopumps 10 shown in FIGS. 3, 4A, and 4B are also likewise designed to have a hydrogen capture probability of at least 20%, at least 25%, or at least 30%.

The hydrogen capture probability is given by the ratio of an actual hydrogen exhaust speed to a theoretical maximum hydrogen exhaust speed in a cryopump having the same aperture as the cryopump 10 (that is, having the same cryopump opening area). The actual hydrogen exhaust speed of the cryopump can be obtained by well-known Monte Carlo simulation. The theoretical hydrogen exhaust speed can be regarded as being equated to conductance of a molecular flow with respect to an opening. The conductance of hydrogen C (hydrogen) is obtained from the conductance of 20° C. air C (20° C. air) by the following expression.

$$C(\text{hydrogen}) = \sqrt{\frac{T}{293.15}} \times \sqrt{\frac{28.8}{M}} \times C(20^\circ\text{ C. air})$$

Here, T is the temperature (K) of a hydrogen gas, and M is the molecular weight of hydrogen (that is, M=2). The conductance of 20° C. air C (20° C. air) is proportional to an opening area A ($m^2$) and is given by C (20° C. air)=116 A. For example, in the case of a cryopump with an aperture of 250 mm, the theoretical hydrogen exhaust speed is about 20840 L/s according to the above expression. At this time, the hydrogen capture probability of 30% is equivalent to the hydrogen exhaust speed of the cryopump of about 6252 L/s.

A cryopanel with no adsorbing material disposed on its surface may be provided, and the cryopanel may be referred to as a condensation cryopanel. That is, a condensation cryopanel cannot adsorb a non-condensable gas and can capture a type 2 gas by condensation. For example, the upper cryopanel 38*a* (for example, the top cryopanel 38*a*1) closer to the cryopump intake port 17 among the upper cryopanels 38*a* may be a condensation cryopanel.

In this embodiment, the purge gas inlet 20 is installed in the container body 16*a* below the cryocooler accommodation cylinder 16*b* so as to blow the purge gas to the distal portion of the cryopanel 38 distant from the second cooling stage 34. In this embodiment, the purge valve 20*a* and the opening portion 20*b* are installed in the side portion of the container body 16*a* at an axial height aligned with the bottom cryopanel 38*b*1. The axial heights of the purge valve 20*a* and the opening portion 20*b* are determined so as to blow the purge gas flow onto the outer peripheral portion of the bottom cryopanel 38*b*1. For example, the purge valve 20*a* and the opening portion 20*b* are at the same axial height as the outer peripheral portion of the bottom cryopanel 38*b*1. In order to facilitate understanding, in FIG. 1, the flow of the purge gas blown from the purge gas inlet 20 to the bottom cryopanel 38*b*1 is schematically indicated by an arrow.

The operation of the cryopump 10 having the configuration described above will be described below. When the cryopump 10 is operated, first, the interior of the vacuum chamber is roughed to about 1 Pa with another appropriate roughing pump before the operation. Thereafter, the cryopump 10 is operated. The first cooling stage 30 and the second cooling stage 34 are respectively cooled to the first cooling temperature and the second cooling temperature by driving of the cryocooler 14. Therefore, the radiation shield 36 and the inlet cryopanel 37 thermally coupled to the first cooling stage 30 are also cooled to the first cooling temperature. The cryopanels 38 thermally coupled to the second cooling stage 34 are cooled to the second cooling temperature.

The inlet cryopanel 37 cools the gas that comes flying from the vacuum chamber toward the cryopump 10. The type 1 gas such as water vapor condenses on the surfaces of the radiation shield 36 and the inlet cryopanel 37. The type 2 gas such as argon and the type 3 gas such as hydrogen enter the internal space of the cryopump 10 from the cryopump intake port 17 because the vapor pressure thereof is not sufficiently low at the first cooling temperature. The type 2 gas entering the cryopanel 38 is cooled and condensed by the cryopanel 38. The type 3 gas is adsorbed in the adsorption region of the cryopanel 38. In this way, the cryopump 10 can exhaust various gases by condensation or adsorption to allow the degree of vacuum in the vacuum chamber to reach a desired level.

A gas is accumulated in the cryopump 10 as the vacuum exhaust operation of the cryopump 10 is continued. The regeneration of the cryopump 10 is performed in order to discharge the accumulated gas to the outside. The regeneration of the cryopump 10 generally includes a temperature rising process, a discharge process, and a cool-down process.

The temperature rising process includes increasing the temperature of the cryopanel 38 to a regeneration temperature (for example, room temperature or a temperature higher than room temperature). A heat source for raising the temperature is, for example, the cryocooler 14. The cryocooler 14 enables temperature rising operation (so-called reverse temperature rising). That is, the cryocooler 14 is configured such that adiabatic compression occurs in the working gas when the drive mechanism provided in the room temperature part 26 operates in the direction opposite to that in the cooling operation. The cryocooler 14 heats the first cooling stage 30 and the second cooling stage 34 with the compression heat obtained in this way. The radiation shield 36 and the cryopanel 38 are heated using the first cooling stage 30 and the second cooling stage 34 as heat sources. Further, the purge gas supplied from the purge valve 20*a* into the cryopump container 16 also contributes to the temperature rising of the cryopump 10. Alternatively, the cryopump 10 may be provided with a heating device such as an electric heater, for example. For example, an electric heater that can be controlled independently of the operation of the cryocooler 14 may be mounted on the first cooling stage 30 and/or the second cooling stage 34 of the cryocooler 14.

In the discharge process, the gas captured in the cryopump 10 is re-vaporized or liquefied and discharged through the vent valve 22 or the rough valve 18 together with the purge gas as a gas, a liquid, or a gas-liquid mixture. In the cool-down process, the cryopump 10 is re-cooled to a cryogenic temperature for vacuum exhaust operation. After the regeneration is completed, the cryopump 10 can start the exhaust operation again.

Figure 2:
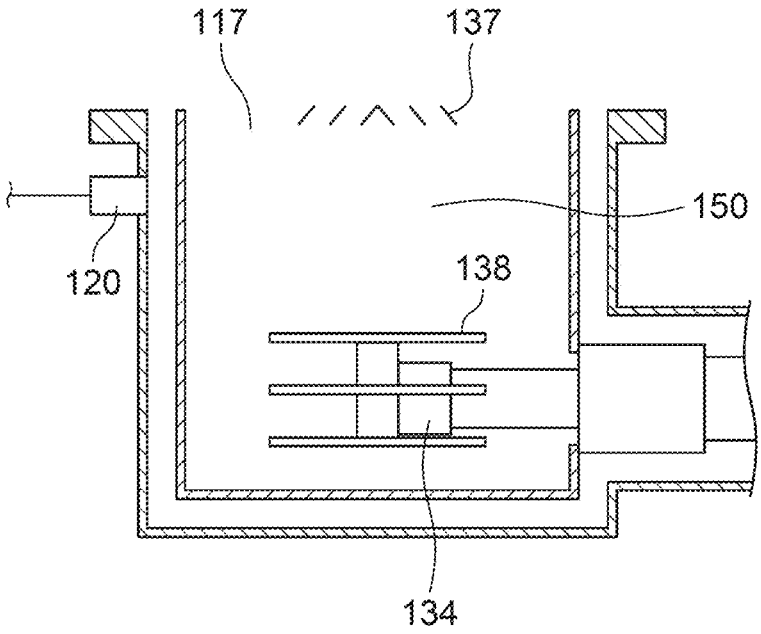
FIG. 2 is a diagram schematically showing a cryopump according to a comparative example.

FIG. 2 is a diagram schematically showing a cryopump according to a comparative example. As shown in FIG. 2, in an existing cryopump, a wide space 150 is often secured between a cryopump intake port 117 (an inlet cryopanel 137) and a top cryopanel 138. The top cryopanel 138 is directly mounted on a second cooling stage 134 of a cryocooler or is disposed in close proximity to the second cooling stage 134. By capturing a type 2 gas such as argon on the top cryopanel 138 by condensation by using the wide space 150, a large amount of type 2 gas can be occluded by the cryopump. Since a purge valve 120 is typically installed in the vicinity of the cryopump intake port 117, the type 2 gas condensed in large amounts on the top cryopanel 138 can be efficiently vaporized and discharged by introducing the purge gas from the purge valve 120 during regeneration. Such a design is common, for example, in cryopumps for physical vapor deposition (PVD) applications.

In contrast, in the cryopump 10 according to the embodiment, a large number of cryopanels 38 are densely disposed instead of taking a large-capacity space in proximity to the cryopump intake port 17. Since each cryopanel 38 can adsorb the non-condensable gas, the cryopump 10 can exhaust the non-condensable gas at high speed. The cryopump 10 is suitable, for example, for vacuum exhaust of an ion implanter.

Since a large number of cryopanels 38 are disposed, the total weight and heat capacity of the cryopanels 38 are relatively large. In a case where reverse temperature rising of the cryocooler 14 is used during regeneration, the second cooling stage 34 serves as the heat source for the cryopanels 38. Since the distal portion of the cryopanel 38 distant from the second cooling stage 34 (for example, the outer peripheral portion of the cryopanel 38) has a longer heat transfer path from the second cooling stage 34, the distal portion is relatively difficult to rise in temperature. Since the lower cryopanel 38*b*, especially the bottom cryopanel 38*b*1, is relatively large, its weight and heat capacity are larger than those of the other cryopanels 38, and since it is distant from the second cooling stage 34, it has a long heat transfer path. If the purge gas is introduced from the vicinity of the cryopump intake port 17 distant from the bottom cryopanel 38*b*1 as in the existing cryopump, the effect of the purge gas to promote the temperature rising of the bottom cryopanel 38*b*1 may be insufficient. The time required to raise the temperature of the entire cryopanel 38 to a predetermined regeneration temperature is determined by the time required to raise the temperature of the distal portion of the lower cryopanel 38*b* distant from the second cooling stage 34 (for example, the outer peripheral portion of the bottom cryopanel 38*b*1). Extending the temperature rising time may lead to an increase in regeneration time, which is not desirable.

According to the embodiment, the purge gas inlet 20 is installed in the container body 16*a* below the cryocooler accommodation cylinder 16*b* so as to blow the purge gas to the distal portion of the cryopanel 38 distant from the second cooling stage 34. The axial heights of the purge valve 20*a* and the opening portion 20*b* are determined so as to blow the purge gas flow onto the outer peripheral portion of the bottom cryopanel 38*b*1. The purge gas that is blown out from the purge valve 20*a* is blown to the outer peripheral portion of the bottom cryopanel 38*b*1 through the opening portion 20*b*. By optimizing the introduction of the purge gas in this manner, the temperature rising of the cryopanel 38, particularly the bottom cryopanel 38*b*1, is promoted. The time required to raise the temperature of the cryopanel 38 can be shortened, and the regeneration time can be shortened.

FIG. 3 is a diagram schematically showing a cryopump according to Modification Example 1. The cryopump 10 shown in FIG. 3 is different from the cryopump 10 shown in FIG. 1 in terms of the shape of the lower cryopanel 38*b*. Each of the lower cryopanels 38*b* including the bottom cryopanel 38*b*1 is disposed parallel to a plane perpendicular to the axial direction (the direction of the cryopump center axis C), as shown in the drawing. The lower cryopanel 38*b* is a flat plate and has a circular shape.

The purge gas inlet 20 is installed in the container body 16*a* below the cryocooler accommodation cylinder 16*b* so as to blow the purge gas to the distal portion of the cryopanel 38 distant from the second cooling stage 34. In this embodiment, the purge valve 20*a* and the opening portion 20*b* are installed in the side portion of the container body 16*a* at an axial height aligned with the bottom cryopanel 38*b*1. The axial heights of the purge valve 20*a* and the opening portion 20*b* are determined so as to blow the purge gas flow parallel to the plane perpendicular to the axial direction to the bottom cryopanel 38*b*1. For example, the purge valve 20*a* and the opening portion 20*b* are at the same axial height as the outer peripheral portion of the bottom cryopanel 38*b*1. The axial heights of the purge valve 20*a* and the opening portion 20*b* may be determined so as to blow the purge gas flow between the bottom cryopanel 38*b*1 and the adjacent lower cryopanel 38*b* immediately above the bottom cryopanel 38*b*1. In order to facilitate understanding, in FIG. 3, the flow of the purge gas that is blown from the purge gas inlet 20 to the bottom cryopanel 38*b*1 is schematically indicated by an arrow.

Even with this configuration, the temperature rising of the cryopanel 38, especially the bottom cryopanel 38*b*1, is promoted. The time required to raise the temperature of the cryopanel 38 can be shortened, and the regeneration time can be shortened.

FIGS. 4A and 4B are diagrams schematically showing a cryopump according to Modification Example 2. The cryopump 10 shown in FIGS. 4A and 4B is different from the cryopump 10 shown in FIG. 1 in terms of the disposition of the cryopanels 38. This cryopump 10 is also a horizontal cryopump as in the embodiments described above.

Each of the plurality of cryopanels 38 extends in the axial direction from above to below with respect to the second cooling stage 34 of the cryocooler 14, as shown in FIG. 4A. The cryopanels 38 are radially disposed when viewed from the cryopump intake port 17, as shown in FIG. 4B. The cryopanels 38 are relatively densely disposed to increase the exhaust speed and storage capacity of a gas (for example, a non-condensable gas). At least 4, or at least 8, or at least 16 cryopanels 38 may be radially disposed. Each cryopanel 38 is mounted on the cryopanel mounting member 42 that is a flat plate (for example, disk-shaped) disposed perpendicular to the axial direction, and is thermally coupled to the second cooling stage 34 via the cryopanel mounting member 42.

More space is allocated to the lower portion of the cryopanel 38, which is disposed between the second cooling stage 34 and the bottom portion of the container body 16*a*, compared to the upper portion of the cryopanel 38, which is disposed between the second cooling stage 34 and the cryopump intake port 17. When the axial distance La from the upper end of the cryopanel 38 to the upper surface of the second cooling stage 34 is 1, the axial distance Lb from the lower end of the cryopanel 38 to the upper surface of the second cooling stage 34 may be in a range of 1 to 3, or in a range of 1 to 2. That is, $La \leq Lb \leq 3La$ (or 2La) may be satisfied.

The purge gas inlet 20 is installed in the container body 16*a* below the cryocooler accommodation cylinder 16*b* so as to blow the purge gas to the distal portion of the cryopanel 38 distant from the second cooling stage 34. In this embodiment, the purge valve 20*a* and the opening portion 20*b* are installed in the side portion of the container body 16*a* at an axial height aligned with the lower portion (for example, the lower end) of the cryopanel 38. In order to facilitate understanding, in FIG. 4A, the flow of the purge gas that is blown from the purge gas inlet 20 to the lower portion of the cryopanel 38 is schematically indicated by an arrow. Even with this configuration, the temperature rising of the cryopanel 38 is promoted. The time required to raise the temperature of the cryopanel 38 can be shortened, and the regeneration time can be shortened.

Figure 5A:
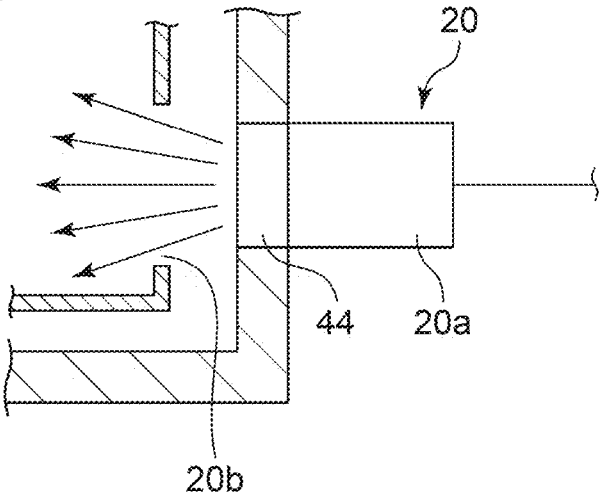
FIGS. 5A to 5C are diagrams schematically showing examples of a purge gas diffuser applicable to the cryopump according to the embodiment.
Figure 5B:
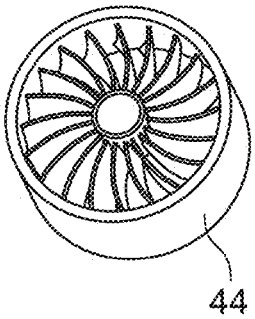
Figure 5C:
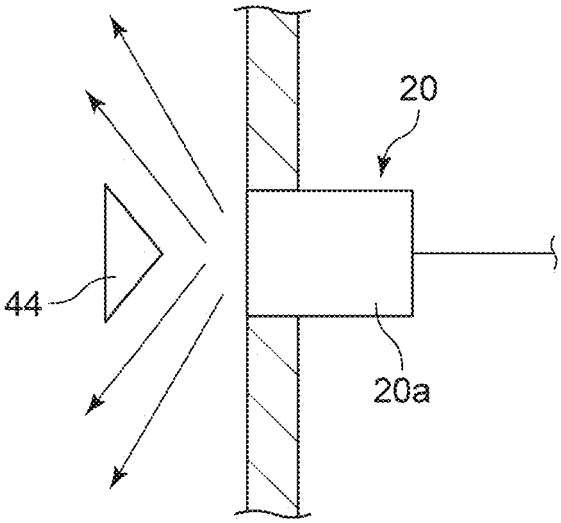

FIGS. 5A to 5C are diagrams schematically showing examples of a purge gas diffuser applicable to the cryopump according to the embodiment. As shown in FIG. 5A, the purge gas inlet 20 may include a purge gas diffuser 44 provided at the outlet of the purge valve 20*a* or the opening portion 20*b*. The purge gas diffuser 44 may be provided with swirl vanes, as shown in FIG. 5B. The swirl vane itself is a fixed vane that is fixedly installed to the purge valve 20*a*, and generates a swirling flow in the purge gas that passes therethrough. By providing the purge gas diffuser 44, the high-speed purge gas flow blown out from the purge valve 20*a* can be diffused and applied to a wider area of the cryopanel 38, thereby promoting the temperature rising of the cryopanel 38.

As shown in FIG. 5C, the purge gas diffuser 44 may be provided with a cone (for example, having a conical shape) that is disposed with the apex thereof facing the outlet of the purge valve 20*a*. Even with this configuration, the high-speed purge gas flow that is blown out from the purge valve 20*a* can be diffused.

The present invention has been described above based on the examples. It will be understood by those skilled in the art that the present invention is not limited to the above embodiments, various design changes can be made, various modification examples are possible, and such modification examples are also within the scope of the present invention.

The purge gas inlet 20 may be provided with a conduit that guides the purge gas from the purge valve 20*a* to the cryopanel 38. The conduit may be provided to penetrate the radiation shield 36. The tip of the conduit may be disposed in the vicinity of the distal portion of the cryopanel 38, and the purge gas inlet 20 may blow the purge gas that is introduced through the conduit from the purge valve 20*a* to the distal portion of the cryopanel 38.

The present invention can be used in the field of cryopumps.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump container comprising a container body and a cryocooler accommodation cylinder, the container body comprising a cryopump intake port, whose pathway extends in an axial direction of the container body, the cryocooler accommodation cylinder connected to a side portion of the container body and extending in a transverse direction perpendicular to the axial direction of the container body;

a cryocooler fixed to the cryocooler accommodation cylinder and extending in the transverse direction within the cryopump container, the cryocooler comprising a first cooling stage and a second cooling stage that is cooled to a lower temperature than the first cooling stage;

a plurality of cryopanels thermally coupled to the second cooling stage, each configured to adsorb a non-condensable gas and comprising a distal portion away from the second cooling stage, wherein the plurality of cryopanels are axially arranged between the cryopump intake port and a bottom portion of the container body, or wherein the plurality of cryopanels are radially arranged when viewed from the cryopump intake port; and a purge gas inlet installed in the container body at a position below the cryocooler accommodation cylinder so as to blow a purge gas from the purge gas inlet to the distal portion of at least one of the cryopanels, wherein the plurality of cryopanels include a plurality of lower cryopanels axially arranged between the second cooling stage and the bottom portion of the container body, and the purge gas inlet is installed in the side portion of the container body at an axial height aligned with a lower cryopanel farthest from the second cooling stage among the plurality of lower cryopanels.

2. The cryopump according to claim 1, wherein the lower cryopanel farthest from the second cooling stage is disposed parallel to a plane perpendicular to the axial direction, and the purge gas inlet is installed in the side portion of the container body at an axial height determined to blow a purge gas flow to the lower cryopanel farthest from the second cooling stage, the purge gas flow directed parallel to the plane perpendicular to the axial direction.

3. The cryopump according to claim 1, wherein the lower cryopanel farthest from the second cooling stage comprises an outer peripheral portion inclined with respect to a plane perpendicular to the axial direction, and the purge gas inlet is installed in the side portion of the container body at an axial height determined to blow a purge gas flow to the outer peripheral portion of the lower cryopanel farthest from the second cooling stage.

4. The cryopump according to claim 1, wherein the plurality of cryopanels include a plurality of upper cryopanels axially arranged between the second cooling stage and the cryopump intake port, and $La \leq Lb \leq 3La$ is satisfied, where La represents an axial distance from an upper cryopanel closest to the cryopump intake port to an upper surface of the second cooling stage and Lb represents an axial distance from the lower cryopanel farthest from the second cooling stage to the upper surface of the second cooling stage.

5. The cryopump according to claim 4, wherein the plurality of upper cryopanels are at least three upper cryopanels axially arranged between the upper surface of the second cooling stage and the cryopump intake port.

6. The cryopump according to claim 4, wherein the plurality of lower cryopanels are at least five lower cryopanels axially arranged between the upper surface of the second cooling stage and the bottom portion of the container body.

7. The cryopump according to claim 1, wherein the purge gas inlet is installed in the side portion of the container body on the same side as the cryocooler accommodation cylinder when viewed from the cryopump intake port.

8. A cryopump comprising:

a cryopump container comprising a container body and a cryocooler accommodation cylinder, the container body comprising a cryopump intake port, whose pathway extends in an axial direction of the container body, the cryocooler accommodation cylinder connected to a side portion of the container body and extending in a transverse direction perpendicular to the axial direction of the container body;

a cryocooler fixed to the cryocooler accommodation cylinder and extending in the transverse direction within the cryopump container, the cryocooler comprising a first cooling stage and a second cooling stage that is cooled to a lower temperature than the first cooling stage;

a plurality of cryopanels thermally coupled to the second cooling stage, each configured to adsorb a non-condensable gas and comprising a distal portion away from the second cooling stage, wherein the plurality of cryopanels are axially arranged between the cryopump intake port and a bottom portion of the container body, or wherein the plurality of cryopanels are radially arranged when viewed from the cryopump intake port; and a purge gas inlet installed in the container body at a position below the cryocooler accommodation cylinder so as to blow a purge gas from the purge gas inlet to the distal portion of at least one of the cryopanels, wherein the plurality of cryopanels are radially arranged when viewed from the cryopump intake port, each of the cryopanels axially extends from upward to downward with respect to the second cooling stage; and the purge gas inlet is installed in the side portion of the container body at an axial height aligned with a lower portion of the cryopanel disposed between the second cooling stage and the bottom portion of the container body.

9. The cryopump according to claim 8, wherein $La \leq Lb \leq 3La$ is satisfied, where La represents an axial distance from upper ends of the plurality of cryopanels to an upper surface of the second cooling stage and Lb represents an axial distance from lower ends of the plurality of cryopanels to the upper surface of the second cooling stage.

10. A cryopump comprising:

a cryopump container comprising a container body and a cryocooler accommodation cylinder, the container body comprising a cryopump intake port, whose pathway extends in an axial direction of the container body, the cryocooler accommodation cylinder connected to a side portion of the container body and extending in a transverse direction perpendicular to the axial direction of the container body;

a cryocooler fixed to the cryocooler accommodation cylinder and extending in the transverse direction within the cryopump container, the cryocooler comprising a first cooling stage and a second cooling stage that is cooled to a lower temperature than the first cooling stage;

a plurality of cryopanels thermally coupled to the second cooling stage, each configured to adsorb a non-condensable gas and comprising a distal portion away from the second cooling stage, wherein the plurality of cryopanels are axially arranged between the cryopump intake port and a bottom portion of the container body, or wherein the plurality of cryopanels are radially arranged when viewed from the cryopump intake port;

a purge gas inlet installed in the container body at a position below the cryocooler accommodation cylinder so as to blow a purge gas from the purge gas inlet to the distal portion of at least one of the cryopanels; and a radiation shield disposed around the plurality of cryopanels within the container body and thermally coupled to the first cooling stage, wherein the purge gas inlet comprises a purge valve installed in the container body at a position below the cryocooler accommodation cylinder to connect the cryopump container to a purge gas source, and the radiation shield is provided with an opening portion through which a purge gas that is ejected from the purge valve into the cryopump container passes into the radiation shield, the opening portion located below the cryocooler accommodation cylinder.

11. The cryopump according to claim 10, wherein the purge gas inlet comprises a purge gas diffuser arranged at an outlet of the purge valve or at the opening portion.

12. The cryopump according to claim 11, wherein the purge gas diffuser comprises a swirl vane.

* * * * *